US007648407B1

(12) United States Patent
Sorensen

(10) Patent No.: US 7,648,407 B1
(45) Date of Patent: Jan. 19, 2010

(54) TOY-BUILDING ELEMENTS HAVING SIDEWALL GROOVES FORMED BETWEEN OUTWARDLY EXTENDING FLEXIBLE RIDGES

(76) Inventor: Soren Christian Sorensen, P.O. Box 31096 SMB, Grand Cayman (KY)

( * ) Notice: Subject to any disclaimer, the term of this patent is extended or adjusted under 35 U.S.C. 154(b) by 0 days.

(21) Appl. No.: 11/181,262

(22) Filed: Jul. 14, 2005

(51) Int. Cl.
*A63H 33/06* (2006.01)
*A63H 33/08* (2006.01)

(52) U.S. Cl. ..... 446/120; 446/124

(58) Field of Classification Search ..... 446/85, 446/116, 120–122, 124, 125, 127–128, 105, 446/117; 273/153 R, 156
See application file for complete search history.

(56) References Cited

U.S. PATENT DOCUMENTS

| | | | | |
|---|---|---|---|---|
| 2,132,757 | A | 10/1938 | Paulson | |
| 2,776,521 | A * | 1/1957 | Zimmerman | 446/115 |
| 3,413,752 | A | 12/1968 | Perry | |
| 3,479,763 | A | 11/1969 | Fischer | |
| 3,745,736 | A * | 7/1973 | Fischer et al. | 52/511 |
| 3,962,817 | A | 6/1976 | Vullirme | |
| 4,099,887 | A * | 7/1978 | Mackenroth | 403/4 |
| D249,232 | S | 9/1978 | Van der Veken | |
| 4,147,007 | A | 4/1979 | Eppich | |
| 4,253,268 | A * | 3/1981 | Mayr | 446/104 |
| 4,355,781 | A * | 10/1982 | Stolpin | 249/64 |
| 4,792,319 | A * | 12/1988 | Svagerko | 446/104 |
| 5,137,485 | A | 8/1992 | Penner | |
| 5,183,430 | A * | 2/1993 | Swann | 446/104 |
| 5,212,842 | A * | 5/1993 | Glydon | 5/420 |
| 5,267,863 | A | 12/1993 | Simmons | |
| 5,310,071 | A | 5/1994 | Rivlin et al. | |
| D363,647 | S | 10/1995 | Rivlin et al. | |
| D367,403 | S | 2/1996 | Rivlin et al. | |
| D369,100 | S | 4/1996 | Johnson | |
| D421,335 | S | 3/2000 | Linard | |
| 6,059,631 | A | 5/2000 | Maddock | |
| 6,250,986 | B1 * | 6/2001 | Sorensen | 446/85 |
| 6,296,541 | B1 | 10/2001 | Bezalel et al. | |
| D460,129 | S | 7/2002 | Barazani et al. | |
| 6,447,360 | B1 | 9/2002 | Sorensen | |
| 6,450,853 | B1 | 9/2002 | Larws | |
| D466,956 | S | 12/2002 | Manville et al. | |
| 6,511,073 | B2 * | 1/2003 | Simonds | 273/299 |

(Continued)

FOREIGN PATENT DOCUMENTS

| | | |
|---|---|---|
| DE | 1 156 688 | 10/1963 |
| EP | 0 766 585 B1 | 6/2000 |

*Primary Examiner*—Gene Kim
*Assistant Examiner*—Alyssa M Hylinski
(74) *Attorney, Agent, or Firm*—Edward W. Callan

(57) ABSTRACT

A toy building element has sidewalls that include grooves and tongues by which the toy building element can be interconnected with a like building element. Each groove is formed between a pair of outwardly extending flexible ridges. In some embodiments, the tongue does not extend outward beyond the virtual plane of the sidewall that includes the tongue. In other embodiments in which the tongue extends outward beyond the tongue-sidewall virtual plane, the distance by which the tongue extends beyond the tongue-sidewall virtual plane is less than (a) the distance by which each ridge of the pair of ridges extends beyond the ridge-sidewall virtual plane, (b) the distance by each ridge of the pair of ridges extends outward to the ridge-sidewall virtual plane and/or (c) the distance by which each side of the tongue extends outward to the tongue-sidewall virtual plane.

4 Claims, 4 Drawing Sheets

U.S. PATENT DOCUMENTS 6,616,499 B1 * 9/2003 Sorensen ..... 446/85
6,648,715 B2 * 11/2003 Wiens et al. ..... 446/121
6,702,642 B1 * 3/2004 Parein ..... 446/105
6,824,440 B2 11/2004 Brener
6,883,719 B2 4/2005 Pyrce
2005/0014441 A1 * 1/2005 Matos ..... 446/85

* cited by examiner

TOY-BUILDING ELEMENTS HAVING SIDEWALL GROOVES FORMED BETWEEN OUTWARDLY EXTENDING FLEXIBLE RIDGES

BACKGROUND OF THE INVENTION

The present invention generally pertains to assembly toys and is particularly directed to toy building elements for a set of toy building elements.

Examples of prior art toy building elements are described in European Patent No. 0,766,585 and in U.S. Pat. Nos. 2,132,757; Des. 249,232; 4,253,268; 6,250,986; 6,296,541; 6,447,360; 6,616,499; 6,648,715, 6,702,642 and 6,824,440.

The toy building elements described in U.S. Pat. No. 6,648,715 includes a top, a bottom and side walls that include grooves and/or tongues. Some of the sidewalls include at least one pair of ridges extending outward from the primary surface of the sidewall that includes the ridges. The ridges form a groove therebetween with an entry opening of a predominant minimum width. The ridges extend beyond the primary surfaces of the respective sidewalls that include the grooves. Some of the sidewalls include at least one tongue having a distal portion of a predominant maximum width that is greater than the predominant minimum width of the groove entry opening for interconnecting in a releasable restraining engagement with a said groove in another said building element. Each tongue extends outward beyond the primary surface of the respective sidewall that includes the tongue.

SUMMARY OF THE INVENTION

The present invention is defined by expressing the outward extension of the ridges and the tongue in relation to the virtual planes of the respective sidewalls.

In another aspect, the present invention provides a building element for a set of toy building elements that are capable of being interconnected in a releasable engagement, comprising: a top, a bottom and sidewalls; wherein at least one of the sidewalls includes at least one pair of outwardly extending ridges forming a groove therebetween in the sidewall with an entry opening of a predominant minimum width; wherein the at least one sidewall includes at least one outwardly extending tongue having a distal portion of a predominant maximum width that is greater than the predominant minimum width of the groove entry opening for interconnecting in a releasable restraining engagement within but not extending through a said groove in another said building element; wherein the at least one tongue extends outward beyond a virtual plane of the at least one sidewall, with said virtual plane being defined as a plane that passes through a midpoint of a line that connects a central point on an outer surface of the at least one sidewall to a central point on an outer surface of a sidewall of the other building element that includes a said at least one pair of ridges and is perpendicular to a line that passes through the central points of said interconnected building elements when said building elements are interconnected in a centered configuration; wherein at least one ridge of said at least one pair of ridges extends outward beyond a the virtual plane of the at least one sidewall; and wherein the at least one tongue extends outward beyond the virtual plane of the at least one sidewall by a lesser distance than the distance by which each ridge of said at least one pair of ridges extends beyond the virtual plane of the at least one sidewall.

Additional features of the present invention are described with reference to the detailed description.

DETAILED DESCRIPTION

Figure 1:
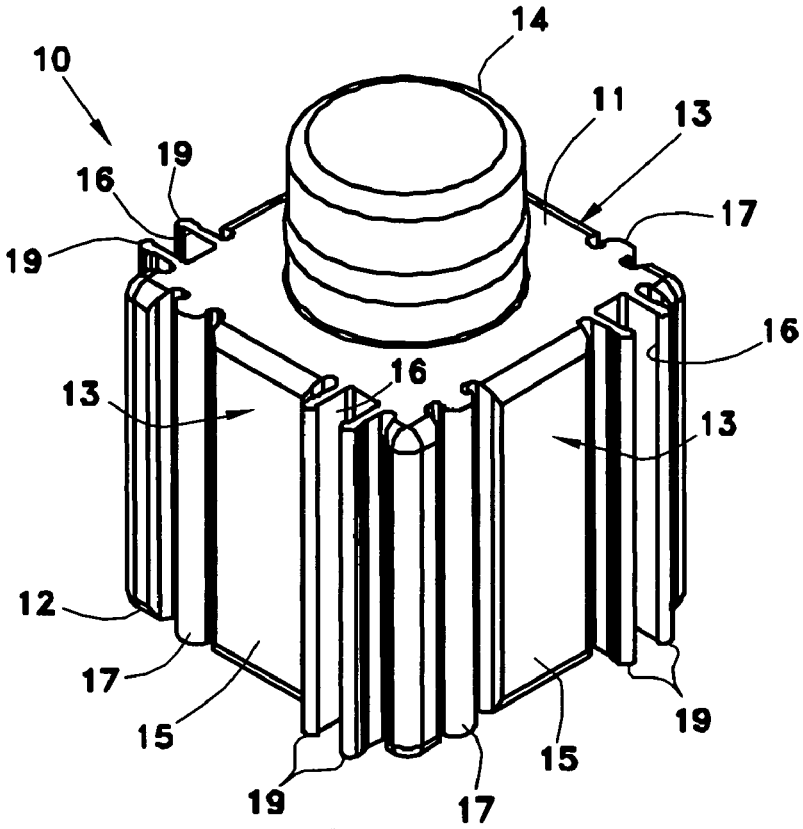
FIG. 1 is a top and two-sided perspective view of one embodiment of a building element according to the present invention.
Figure 2:
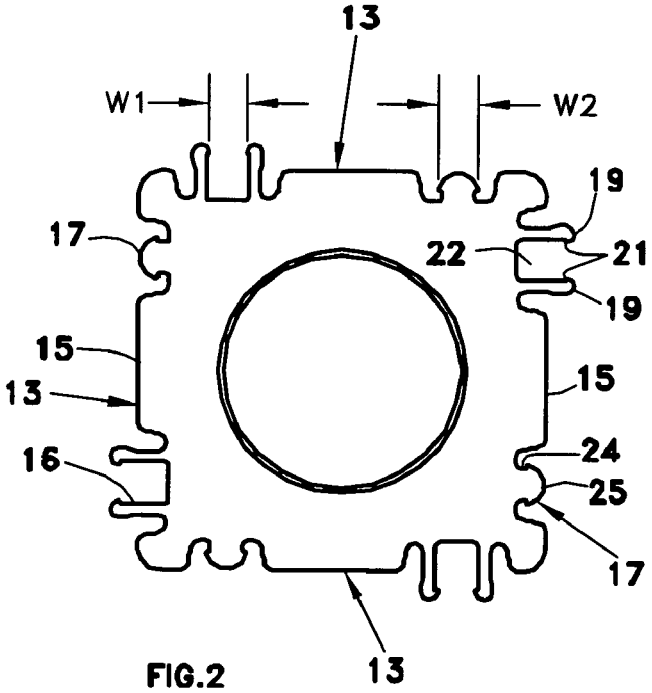
FIG. 2 is a top view of the building element of FIG. 1.
Figure 2A:
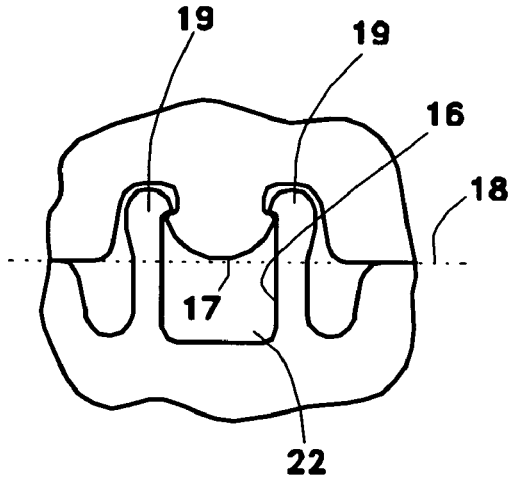
FIG. 2A is an enlarged partial top view illustrating a releasable restraining engagement between the tongue and the ridge portions of the side wall that form the groove in accordance with the embodiment of the building element shown in FIG. 2 when the distal portion of the tongue of one such building element resides in the groove of another such building element.

Referring to FIGS. 1, 2 and 2A, a toy building element 10 according to one embodiment of the present invention includes a top 11, a bottom 12 and four sidewalls 13. The top 11 of the building element 10 includes a primarily cylindrical projection 14 and the bottom 12 of the building element 10 is open. In alternative embodiments (not shown) more than one projection extends above the top broad surface.

The interior (not shown) of the building element 10 has contact surfaces that are accessible through the open bottom and are adapted for effecting a releasable restraining engagement with an interconnectable projection on a second toy-building element. In alternative embodiments (not shown) the interior contact surfaces are adapted for effecting releasable restraining engagements with a plurality of interconnectable projections on another toy-building element or on a combination of other toy building elements. In the preferred embodiments, the projection 14 and the interior contact surfaces are configured as described in aforementioned U.S. Pat. No. 6,447,360, the disclosure of which is incorporated by reference. Other configurations may be used in other embodiments.

Each of the sidewalls 13 includes a primary surface 15, at least one groove 16 and at least one tongue 17. In this embodiment, the primary surface 15 is within both the virtual plane of the sidewall 13 that includes the groove 16 and the virtual plane of the sidewall that includes the tongue 17 when building elements respectively including a groove 16 and a tongue 17 are interconnected in a centered configuration. The coincident ridge-sidewall virtual plane and tongue-sidewall virtual plane are indicated by dotted line 18 in FIG. 2A. In some alternative embodiments (not shown) in which the primary surface of the sidewall that includes the ridges and/or the tongue is non-planar, the respective ridge-sidewall virtual plane and/or tongue-sidewall virtual plane might include all of the primary surface of the sidewall that includes the groove and/or the tongue.

Each groove 16 is configured and dimensioned for effecting a releasable restraining engagement with a tongue 17 in a sidewall of another toy-building element; and each tongue 17 is configured and dimensioned for effecting a releasable restraining engagement with a groove 16 in a sidewall of another toy-building element, as shown in FIG. 2A.

In the preferred embodiments, the grooves 16 and the tongues 17 are configured and relatively dimensioned as described in aforementioned U.S. Pat. Nos. 6,250,986 and 6,616,499, the disclosures of which are incorporated by reference. Preferably, the relative dimensions of the groove 16 and the tongue 17 are such that when the distal portion 25 of the tongue 17 resides in the base region 22 of the groove 16, part of the tongue 17 is compressed between and thereby frictionally engages the ridges 19. The degree of the frictional engagement provided by the compression of the tongue 17 when the distal portion 25 of the tongue 17 resides in the base region 22 of the groove 16 is such as to enable a stationary relative disposition of a pair of so engaged building elements 10 to be varied precisely by smoothly sliding the tongue 17 of one of the pair of engaged building elements 10 within the groove 16 of the other of the pair of engaged building elements 10, and also is such as to provide enough resistance to such sliding as to maintain the stationary relative disposition when one of the pair of engaged building elements has the top of its engaged side wall 13 disposed at a greater height than the top of the engaged side wall 13 of the other of the pair of building elements 10.

Other configurations and relative dimensions of the grooves and tongues may be used in other embodiments.

Each groove 16 is formed between a pair of ridges 19 that extend outward to and thence beyond the virtual plane 18 of the sidewall 13 that includes the ridges 19.

Each groove 16 has an entry opening 21 of a predominant minimum width W1 and a base region 22 of a greater width than the predominant minimum width W1. The predominant minimum width W1 of the entry opening 21 is the minimum width of the groove 16 that predominates over the length of the groove 16 between the top 11 and the bottom 12 of the building element 10.

Each tongue 17 has an indented trunk portion 24 and a distal portion 25. The distal portion 25 has a predominant maximum width W2 that is greater than the width of the indented trunk portion 24 and greater than the predominant minimum width W1 of the groove entry opening 21 for interconnecting in a releasable restraining engagement with a groove 16 in a side wall 13 of another such building element 10 so that the distal portion 25 of the tongue resides in the base region 22 of the groove 16, as shown in FIG. 2A. The predominant maximum width W2 of the distal portion 23 is the maximum width of the distal portion 23 that predominates over the length of the tongue 17 between the top 11 and the bottom 12 of the building element 10.

Each of the ridges 19 is flexible in a lateral direction to thereby facilitate engagement of the distal portion 25 of the tongue 17 in the groove 16 of another building element by frontally pressing the tongue 17 into the groove 16 of another building element. Such a restraining engagement can also be effected by sliding the tongue 17 of one building element into the open end of the groove 16 of another building element.

The tongue 17 extends outward to but not beyond the primary surface 15 of the sidewall that includes the tongue 17.

The groove-forming ridges 19 and the tongues 17 extend between the top 11 and the bottom 12 of the building element 10. Preferably, the maximum width of the distal portion 25 at the ends of the tongue 17 adjacent the top 11 and the bottom 12 of the building element 10 is the same or smaller than the given predominant minimum width W1 of the groove entry opening 21 to thereby facilitate initiation of interconnection of the building elements 10 when sliding the tongues 17 into either end of the grooves 16. Initiation of the interconnection of the building elements 10 that is effected by sliding the tongues 17 into the ends of the grooves 16 is also facilitated by the minimum width of the entry opening 21 at the ends of the grooves 16 adjacent the top 11 and the bottom 12 of the building element 10 being the same or greater than the given predominant minimum width W1 of the groove entry opening 21.

In other embodiments in which the grooves and tongues are disposed and respectively extend in relation to the primary surface 15 and the respective virtual planes 18, as shown in and described with reference to FIGS. 1, 2 and 2A, any particular sidewall may include none, one or more than one such groove 16 and/or tongue 17.

Figure 3:
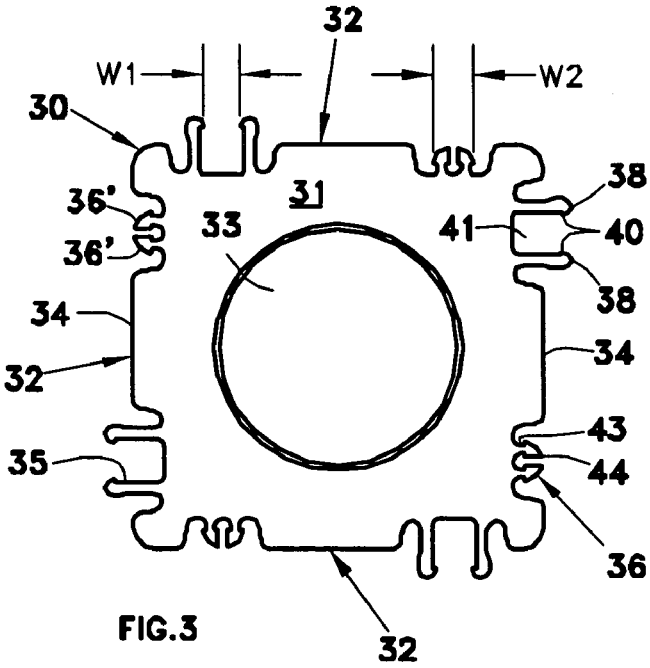
FIG. 3 is a top view of another embodiment of a building element according to the present invention.
Figure 3A:
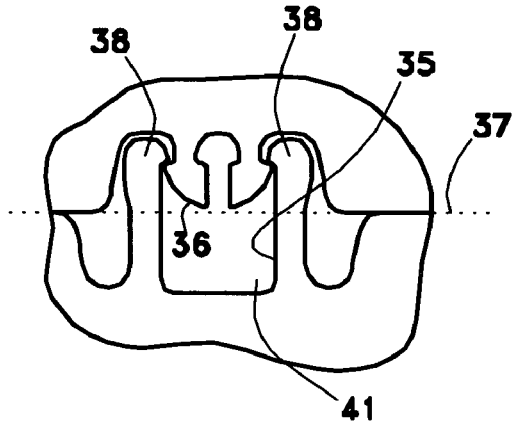
FIG. 3A is an enlarged partial top view illustrating a releasable restraining engagement between the tongue and the ridge portions of the side wall that form the groove in accordance with the embodiment of the building element shown in FIG. 3 when the distal portion of the tongue of one such building element resides in the groove of another such building element.

Referring to FIGS. 3 and 3A, a toy building element 30 according to another embodiment of the present invention includes a top 31, a bottom (not shown) and four sidewalls 32. The top 31 of the building element 30 includes a primarily cylindrical projection 33 and the bottom (not shown) of the building element 30 is open. In alternative embodiments (not shown) more than one projection extends above the top broad surface.

Each of the sidewalls 32 includes a primary surface 34, at least one groove 35 and at least one tongue 36. In this embodiment, the primary surface 34 is within both the virtual plane of the sidewall 32 that includes the groove 35 and the virtual plane of the sidewall that includes the tongue 36 when building elements respectively including a groove 35 and a tongue 36 are interconnected in a centered configuration. The coincident ridge-sidewall virtual plane and tongue-sidewall virtual plane are indicated by dotted line 37 in FIG. 3A. In some alternative embodiments (not shown) in which the primary surface of the sidewall that includes the ridges and/or the tongue is non-planar, the respective ridge-sidewall virtual plane and/or tongue-sidewall virtual plane might include all of the primary surface of the sidewall that includes the groove and/or the tongue.

Each groove 35 is configured and dimensioned for effecting a releasable restraining engagement with a tongue 36 in a sidewall of another toy-building element; and each tongue 36 is configured and dimensioned for effecting a releasable restraining engagement with a groove 35 in a sidewall of another toy-building element, as shown in FIG. 3A.

Each groove 35 is formed between a pair of ridges 38 that extend outward to and thence beyond the virtual plane 37 of the sidewall 32 that includes the ridges 38.

Each groove 35 has an entry opening 40 of a predominant minimum width W1 and a base region 41 of a greater width than the predominant minimum width W1. The predominant minimum width W1 of the entry opening 40 is the minimum width of the groove 35 that predominates over the length of the groove 35 between the top 31 and the bottom of the building element 30.

Each tongue 36 has an indented trunk portion 43 and a distal portion 44. The distal portion 44 has a predominant maximum width W2 that is greater than the width of the indented trunk portion 43 and greater than the predominant minimum width W1 of the groove entry opening 40 for interconnecting in a releasable restraining engagement with a groove 35 in a side wall 32 of another such building element 30 so that the distal portion 44 of the tongue resides in the base region 41 of the groove 35, as shown in FIG. 3A. The predominant maximum width W2 of the distal portion 44 is the maximum width of the distal portion 44 that predominates over the length of the tongue 36 between the top 31 and the bottom of the building element 30.

The tongue 36 is flexible and split longitudinally into two laterally flexible parallel sections 36'. Each of the parallel sections 36' of the tongue 36 includes part of the indented trunk portion 43 and part of the distal portion 44 of the tongue 36 so that the distal portion 44 of the tongue 36 can be compressed laterally in order to effect the restraining engagement in the groove 35 by frontally pressing the tongue 36 into the groove 35 in another building element. Such a restraining engagement can also be effected by sliding the tongue 36 of one building element into the open end of the groove 35 of another building element.

Each of the ridges 38 is flexible in a lateral direction to thereby further facilitate the engagement of the distal portion 44 of the tongue 36 in the groove 35 of another building element by frontally pressing the tongue 36 into the groove 35 of another building element.

The tongue 36 extends outward to but not beyond the primary surface 34 of the sidewall that includes the tongue 36.

In other respects, the building element 30 described in relation to FIGS. 3 and 3A preferably is configured and dimensioned in the same manner as the building element 10 described above in relation to FIGS. 1, 2 and 2A.

In other embodiments in which the grooves and tongues are disposed and respectively extend in relation to the primary surface 34 and the respective virtual planes 37, as shown in and described with reference to FIGS. 3 and 3A, any particular sidewall may include none, one or more than one such groove 35 and/or tongue 36.

Figure 4:
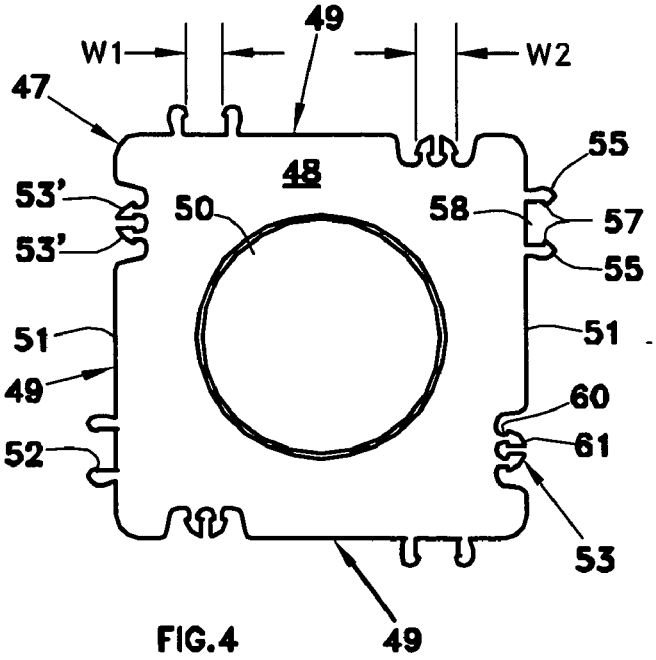
FIG. 4 is a top view of still another embodiment of a building element according to the present invention.
Figure 4A:
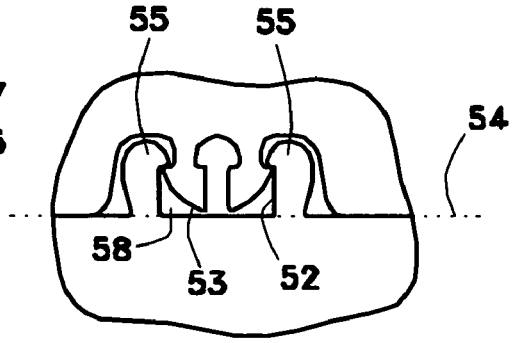
FIG. 4A is an enlarged partial top view illustrating a releasable restraining engagement between the tongue and the ridge portions of the side wall that form the groove in accordance with the embodiment of the building element shown in FIG. 4 when the distal portion of the tongue of one such building element resides in the groove of another such building element.

Referring to FIGS. 4 and 4A, a toy building element 47 according to another embodiment of the present invention includes a top 48, a bottom (not shown) and four sidewalls 49. The top 48 of the building element 47 includes a primarily cylindrical projection 50 and the bottom (not shown) of the building element 47 is open. In alternative embodiments (not shown) more than one projection extends above the top broad surface.

Each of the sidewalls 49 includes a primary surface 51, at least one groove 52 and at least one tongue 53. In this embodiment, the primary surface 51 is within both the virtual plane of the sidewall 49 that includes the groove 52 and the virtual plane of the sidewall that includes the tongue 53 when building elements respectively including a groove 52 and a tongue 53 are interconnected in a centered configuration. The coincident ridge-sidewall virtual plane and tongue-sidewall virtual plane are indicated by dotted line 54 in FIG. 4A. In some alternative embodiments (not shown) in which the primary surface of the sidewall that includes the ridges and/or the tongue is non-planar, the respective ridge-sidewall virtual plane and/or tongue-sidewall virtual plane might include all of the primary surface of the sidewall that includes the groove and/or the tongue.

Each groove 52 is configured and dimensioned for effecting a releasable restraining engagement with a tongue 53 in a sidewall of another toy-building element; and each tongue 53 is configured and dimensioned for effecting a releasable restraining engagement with a groove 53 in a sidewall of another toy-building element, as shown in FIG. 4A.

Each groove 52 is formed between a pair of ridges 55 that extend outward from a location in the virtual plane 54 of the sidewall 49 that includes the ridges 55.

Each groove 52 has an entry opening 57 of a predominant minimum width W1 and a base region 58 of a greater width than the predominant minimum width W1. The predominant minimum width W1 of the entry opening 57 is the minimum width of the groove 52 that predominates over the length of the groove 52 between the top 48 and the bottom of the building element 47.

Each tongue 53 has an indented trunk portion 60 and a distal portion 61. The distal portion 60 has a predominant maximum width W2 that is greater than the width of the indented trunk portion 60 and greater than the predominant minimum width W1 of the groove entry opening 57 for interconnecting in a releasable restraining engagement with a groove 52 in a side wall 49 of another such building element 47 so that the distal portion 61 of the tongue resides in the base region 58 of the groove 52, as shown in FIG. 4A. The predominant maximum width W2 of the distal portion 61 is the maximum width of the distal portion 61 that predominates over the length of the tongue 53 between the top 48 and the bottom of the building element 47.

The tongue 53 is flexible and split longitudinally into two laterally flexible parallel sections 53'. Each of the parallel sections 53' of the tongue 53 includes part of the indented trunk portion 60 and part of the distal portion 61 of the tongue 53 so that the distal portion 61 of the tongue 53 can be compressed laterally in order to effect the restraining engagement in the groove 52 by frontally pressing the tongue 53 into the groove 52 in another building element. Such a restraining engagement can also be effected by sliding the tongue 53 of one building element into the open end of the groove 52 of another building element.

Each of the ridges 55 is flexible in a lateral direction to thereby further facilitate the engagement of the distal portion 61 of the tongue 53 in the groove 52 of another building element by frontally pressing the tongue 53 into the groove 52 of another building element.

The tongue 53 extends outward to but not beyond the primary surface 51 of the sidewall that includes the tongue 53.

In other respects, the building element 46 described in relation to FIGS. 4 and 4A preferably is configured and dimensioned in the same manner as the building element 10 described above in relation to FIGS. 1, 2 and 2A.

In other embodiments in which the grooves and tongues are disposed and respectively extend in relation to the primary surface 51 and the respective virtual planes 54, as shown in and described with reference to FIGS. 4 and 4A, any particular sidewall may include none, one or more than one such groove 52 and/or tongue 53.

Figure 5:
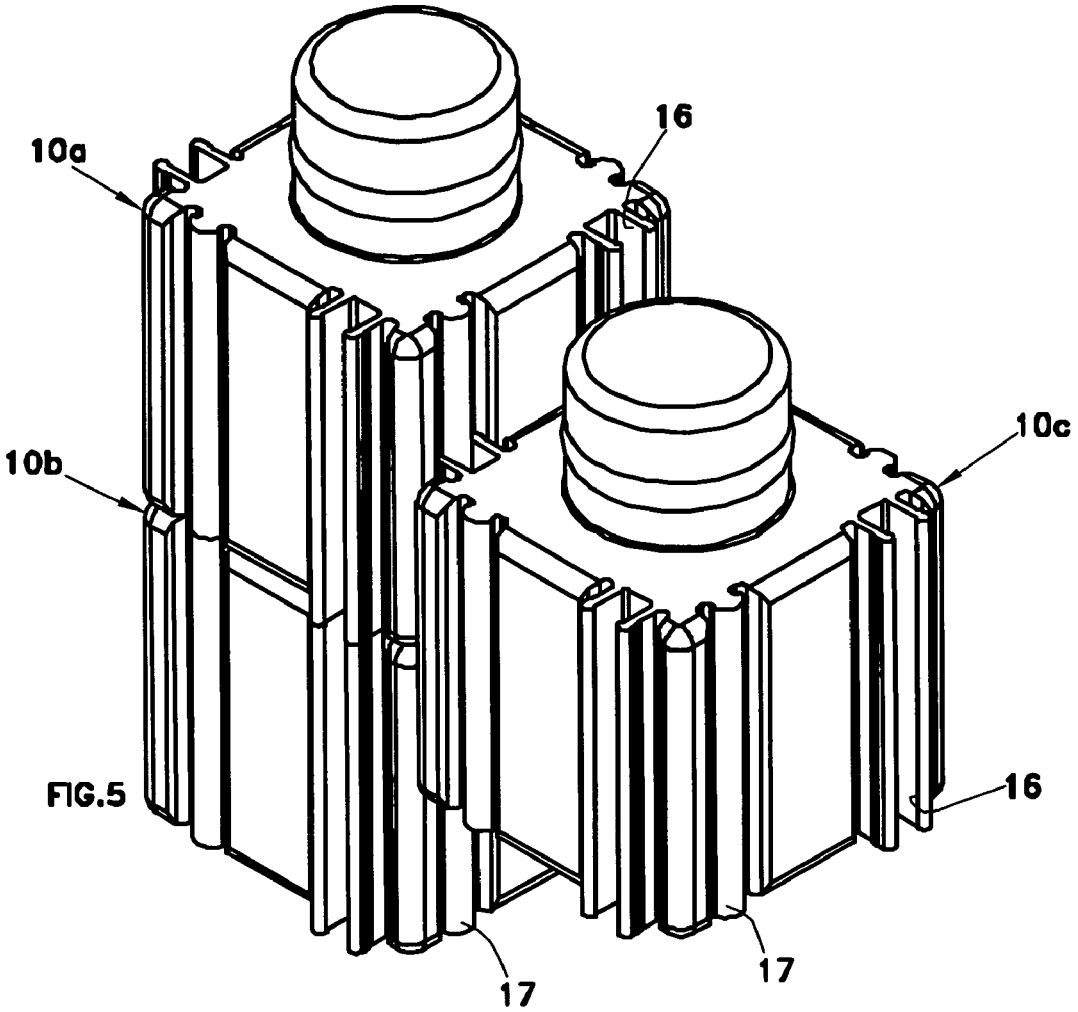
FIG. 5 is a top and two-sided perspective view illustrating the interconnection of a set of the building elements shown in FIG. 1.

Referring to FIG. 5, three building elements 10*a*. 10*b*, 10*c*, are interconnected with one another. The building elements 10*a*, 10*b* 10*c* are the same as the building element 10, which is described above with reference to FIGS. 1, 2 and 2A. The building element 10*a* is interconnected with the building element 10*b* by engaging the projection on the top of building element 10*b* with the interior surfaces of the building element 10*a*. The building element 10*c* is engaged with both of the building elements 10*a* and 10*b* by engaging the tongues and grooves in one sidewall of the building element 10*c* with the respective grooves and tongues in the sidewalls of the building elements 10*a* and 10*b* by either frontally pressing the tongues into the grooves or by sliding the tongues into the grooves from the open ends of the respective grooves.

Figure 6:
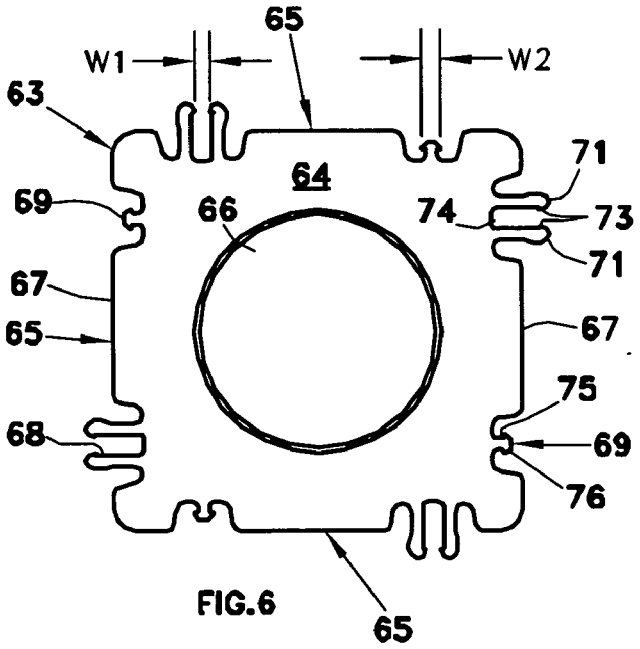
FIG. 6 is a top view of yet another embodiment of a building element according to the present invention.
Figure 6A:
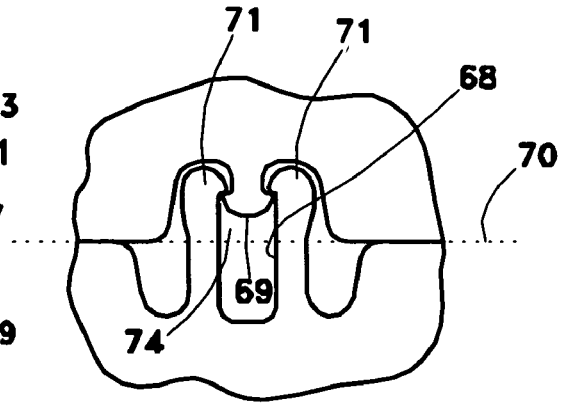
FIG. 6A is an enlarged partial top view illustrating a releasable restraining engagement between the tongue and the ridge portions of the side wall that form the groove in accordance with the embodiment of the building element shown in FIG. 6 when the distal portion of the tongue of one such building element resides in the groove of another such building element.

Referring to FIGS. 6 and 6A, a toy building element 64 according to another embodiment of the present invention includes a top 65, a bottom (not shown) and four sidewalls 66. The top 65 of the building element 64 includes a primarily cylindrical projection 67 and the bottom (not shown) of the building element 64 is open. In alternative embodiments (not shown) more than one projection extends above the top broad surface.

Each of the sidewalls 66 includes a primary surface 67, at least one groove 68 and at least one tongue 69. In this embodiment, the primary surface 67 is within both the virtual plane of the sidewall 66 that includes the groove 68 and the virtual plane of the sidewall that includes the tongue 69 when building elements respectively including a groove 68 and a tongue 69 are interconnected in a centered configuration. The coincident ridge-sidewall virtual plane and tongue-sidewall virtual plane are indicated by dotted line 70 in FIG. 6A. In some alternative embodiments (not shown) in which the primary surface of the sidewall that includes the ridges and/or the tongue is non-planar, the respective ridge-sidewall virtual plane and/or tongue-sidewall virtual plane might include all of the primary surface of the sidewall that includes the groove and/or the tongue.

Each groove 68 is configured and dimensioned for effecting a releasable restraining engagement with a tongue 69 in a sidewall of another toy-building element; and each tongue 69 is configured and dimensioned for effecting a releasable restraining engagement with a groove 68 in a sidewall of another toy-building element, as shown in FIG. 6A.

Each groove 68 is formed between a pair of ridges 71 that extend outward to and thence beyond the virtual plane 70 of the sidewall 66 that includes the ridges 71.

Each groove 68 has an entry opening 73 of a predominant minimum width W1 and a base region 74 of a greater width than the predominant minimum width W1. The predominant minimum width W1 of the entry opening 73 is the minimum width of the groove 68 that predominates over the length of the groove 68 between the top 65 and the bottom of the building element 64.

Each tongue 69 has an indented trunk portion 75 and a distal portion 76. The distal portion 76 has a predominant maximum width W2 that is greater than the width of the indented trunk portion 75 and greater than the predominant minimum width W1 of the groove entry opening 73 for interconnecting in a releasable restraining engagement with a groove 68 in a side wall 66 of another such building element 64 so that the distal portion 76 of the tongue resides in the base region 74 of the groove 68, as shown in FIG. 6A. The predominant maximum width W2 of the distal portion 76 is the maximum width of the distal portion 76 that predominates over the length of the tongue 69 between the top 65 and the bottom of the building element 64.

The predominant minimum width W1 of the entry opening 73 is less than the predominant minimum width W1 of the entry opening 21 in the embodiment of FIGS. 1, 2 and 2A; and the predominant maximum width W2 of the distal portion 76 is less than the predominant maximum width W2 of the distal portion in the embodiment of FIGS. 1, 2 and 2A.

Each of the ridges 71 is flexible in a lateral direction to thereby facilitate engagement of the distal portion 76 of the tongue 69 in the groove 68 of another building element by frontally pressing the tongue 69 into the groove 68 of another building element. Such a restraining engagement can also be effected by sliding the tongue 69 of one building element into the open end of the groove 68 of another building element.

The tongue 69 extends outward but not all the way to the primary surface 70 of the sidewall 66 that includes the tongue 69.

Each tongue 69 has an indented trunk portion 75 and a distal portion 76. The distal portion 76 has a predominant maximum width W2

In other respects, the building element 64 described in relation to FIGS. 6 and 6A preferably is configured and dimensioned in the same manner as the building element 10 described above in relation to FIGS. 1, 2 and 2A.

In other embodiments in which the grooves and tongues are disposed and respectively extend in relation to the primary surface 67 and the respective virtual planes 70, as shown in and described with reference to FIGS. 6 and 6A, any particular sidewall may include none, one or more than one such groove 68 and/or tongue 69.

Figure 7:
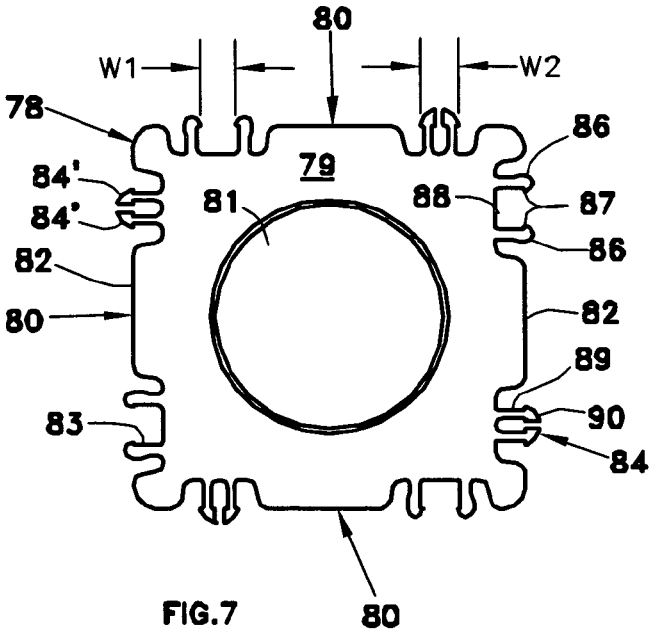
FIG. 7 is a top view of a further embodiment of a building element according to the present invention.
Figure 7A:
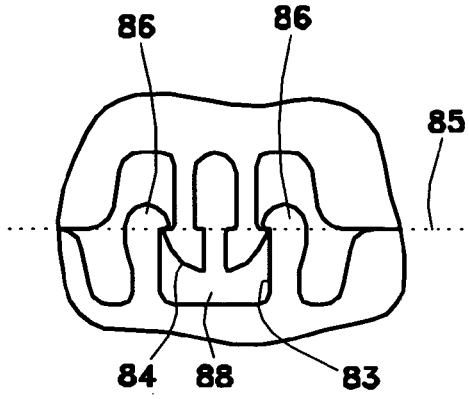
FIG. 7A is an enlarged partial top view illustrating a releasable restraining engagement between the tongue and the ridge portions of the side wall that form the groove in accordance with the embodiment of the building element shown in FIG. 7 when the distal portion of the tongue of one such building element resides in the groove of another such building element.

Referring to FIGS. 7 and 7A, a toy building element 78 according to another embodiment of the present invention includes a top 79, a bottom (not shown) and four sidewalls 80. The top 79 of the building element 78 includes a primarily cylindrical projection 81 and the bottom (not shown) of the building element 78 is open. In alternative embodiments (not shown) more than one projection extends above the top broad surface.

Each of the sidewalls 80 includes a primary surface 82, at least one groove 83 and at least one tongue 84. In this embodiment, the primary surface 82 is within both the virtual plane of the sidewall 80 that includes the groove 83 and the virtual plane of the sidewall 80 that includes the tongue 84 when building elements respectively including a groove 83 and a tongue 84 are interconnected in a centered configuration. The coincident ridge-sidewall virtual plane and tongue-sidewall virtual plane are indicated by dotted line 85 in FIG. 7A. In some alternative embodiments (not shown) in which the primary surface of the sidewall that includes the ridges and/or the tongue is non-planar, the respective ridge-sidewall virtual plane and/or tongue-sidewall virtual plane might include all of the primary surface of the sidewall that includes the groove and/or the tongue.

Each groove 83 is configured and dimensioned for effecting a releasable restraining engagement with a tongue 84 in a sidewall of another toy-building element; and each tongue 84 is configured and dimensioned for effecting a releasable restraining engagement with a groove 83 in a sidewall of another toy-building element, as shown in FIG. 7A.

Each groove 83 is formed between a pair of ridges 86 that extend outward to and thence beyond the virtual plane 85 of the sidewall 80 that includes the ridges 86.

Each groove 83 has an entry opening 87 of a predominant minimum width W1 and a base region 88 of a greater width than the predominant minimum width W1. The predominant minimum width W1 of the entry opening 87 is the minimum width of the groove 83 that predominates over the length of the groove 83 between the top 79 and the bottom of the building element 78.

Each tongue 84 has an indented trunk portion 89 and a distal portion 90. The distal portion 90 has a predominant maximum width W2 that is greater than the width of the indented trunk portion 89 and greater than the predominant minimum width W1 of the groove entry opening 87 for interconnecting in a releasable restraining engagement with a groove 83 in a side wall 80 of another such building element 78 so that the distal portion 90 of the tongue resides in the base region 88 of the groove 83, as shown in FIG. 7A. The predominant maximum width W2 of the distal portion 90 is the maximum width of the distal portion 90 that predominates over the length of the tongue 84 between the top 79 and the bottom of the building element 78.

The tongue 84 is flexible and split longitudinally into two laterally flexible parallel sections 84'. Each of the parallel sections 84' of the tongue 84 includes part of the indented trunk portion 89 and part of the distal portion 90 of the tongue 84 so that the distal portion 90 of the tongue 84 can be compressed laterally in order to effect the restraining engagement in the groove 83 by frontally pressing the tongue 84 into the groove 83 in another building element. Such a restraining engagement can also be effected by sliding the tongue 84 of one building element into the open end of the groove 83 of another building element.

Each of the ridges 86 is flexible in a lateral direction to thereby further facilitate the engagement of the distal portion 90 of the tongue 84 in the groove 83 of another building element by frontally pressing the tongue 84 into the groove 83 of another building element.

The tongue 84 extends outward to and beyond the tongue-sidewall virtual plane 85 of the sidewall 80 that includes the tongue 84. The tongue 84 extends outward beyond the tongue-sidewall virtual plane 85 by a lesser distance than the distance by which each ridge 86 extends outward to the ridge-sidewall virtual plane 85. Preferably, the distance by which the tongue 84 extends in an outward direction beyond the tongue-sidewall virtual plane 85 is less than half the distance by which each ridge 86 extends outward to the ridge-sidewall virtual plane 85.

The tongue 84 also extends outward beyond the tongue-sidewall virtual plane 85 by a lesser distance than the distance by which each outer side of the tongue 84 extends outward to the tongue-sidewall virtual plane 85. When the tongue is split, as in this embodiment, the distance(s) by which the inner sides (inside the split) of the tongue extend is immaterial when determining the distance by which the outer side of the tongue 84 extends. Preferably, the distance by which the tongue 84 extends in an outward direction beyond the tongue-sidewall virtual plane 85 is less than half the distance by which each outer side of the tongue 84 extends outward to the tongue-sidewall virtual plane 85.

In other respects, the building element 78 described in relation to FIGS. 7 and 7A preferably is configured and dimensioned in the same manner as the building element 10 described above in relation to FIGS. 1, 2 and 2A.

In other embodiments in which the grooves and tongues are disposed and respectively extend in relation to the primary surface 82 and the respective virtual planes 85, as shown in and described with reference to FIGS. 7 and 7A, any particular sidewall may include none, one or more than one such groove 83 and/or tongue 84.

Figure 8:
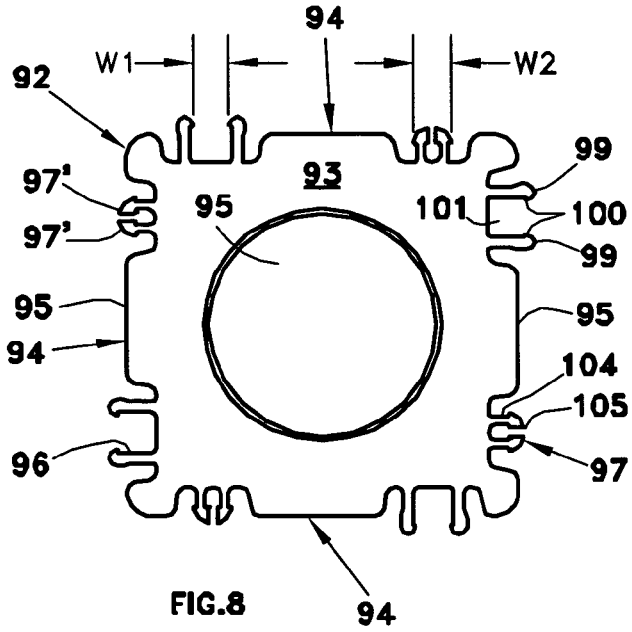
FIG. 8 is a top view of an additional embodiment of a building element according to the present invention.
Figure 8A:
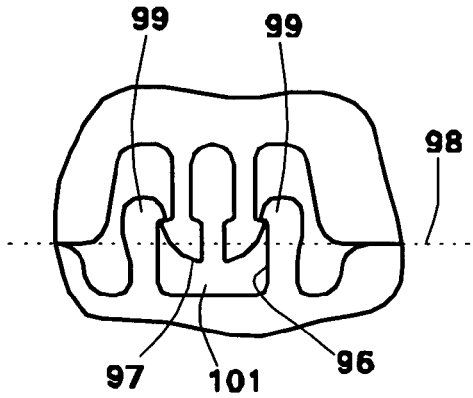
FIG. 8A is an enlarged partial top view illustrating a releasable restraining engagement between the tongue and the ridge portions of the side wall that form the groove in accordance with the embodiment of the building element shown in FIG. 8 when the distal portion of the tongue of one such building element resides in the groove of another such building element.

Referring to FIGS. 8 and 8A, a toy building element 92 according to another embodiment of the present invention includes a top 93, a bottom (not shown) and four sidewalls 94. The top 93 of the building element 92 includes a primarily cylindrical projection 95 and the bottom (not shown) of the building element 92 is open. In alternative embodiments (not shown) more than one projection extends above the top broad surface.

Each of the sidewalls 94 includes a primary surface 95, at least one groove 96 and at least one tongue 97. In this embodiment, the primary surface 95 is within both the virtual plane of the sidewall 94 that includes the groove 96 and the virtual plane of the sidewall 94 that includes the tongue 97 when building elements respectively including a groove 96 and a tongue 97 are interconnected in a centered configuration. The coincident ridge-sidewall virtual plane and tongue-sidewall virtual plane are indicated by dotted line 98 in FIG. 8A. In some alternative embodiments (not shown) in which the primary surface of the sidewall that includes the ridges and/or the tongue is non-planar, the respective ridge-sidewall virtual plane and/or tongue-sidewall virtual plane might include all of the primary surface of the sidewall that includes the groove and/or the tongue.

Each groove 96 is configured and dimensioned for effecting a releasable restraining engagement with a tongue 97 in a sidewall of another toy-building element; and each tongue 97 is configured and dimensioned for effecting a releasable restraining engagement with a groove 96 in a sidewall of another toy-building element, as shown in FIG. 8A.

Each groove 96 is formed between a pair of ridges 99 that extend outward to and thence beyond the virtual plane 98 of the sidewall 94 that includes the ridges 99.

Each groove 96 has an entry opening 100 of a predominant minimum width W1 and a base region 101 of a greater width than the predominant minimum width W1. The predominant minimum width W1 of the entry opening 100 is the minimum width of the groove 96 that predominates over the length of the groove 96 between the top 93 and the bottom of the building element 92.

Each tongue 97 has an indented trunk portion 104 and a distal portion 105. The distal portion 105 has a predominant maximum width W2 that is greater than the width of the indented trunk portion 104 and greater than the predominant minimum width W1 of the groove entry opening 100 for interconnecting in a releasable restraining engagement with a groove 96 in a side wall 94 of another such building element 92 so that the distal portion 105 of the tongue 97 resides in the base region 101 of the groove 96, as shown in FIG. 8A. The predominant maximum width W2 of the distal portion 105 is the maximum width of the distal portion 105 that predominates over the length of the tongue 97 between the top 93 and the bottom of the building element 92.

The tongue 97 is flexible and split longitudinally into two laterally flexible parallel sections 97'. Each of the parallel sections 97' of the tongue 97 includes part of the indented trunk portion 104 and part of the distal portion 105 of the tongue 97 so that the distal portion 105 of the tongue 97 can be compressed laterally in order to effect the restraining engagement in the groove 96 by frontally pressing the tongue 97 into the groove 96 in another building element. Such a restraining engagement can also be effected by sliding the tongue 97 of one building element into the open end of the groove 96 of another building element.

Each of the ridges 99 is flexible in a lateral direction to thereby further facilitate the engagement of the distal portion 105 of the tongue 97 in the groove 96 of another building element by frontally pressing the tongue 97 into the groove 96 of another building element.

The tongue 97 extends outward to and beyond the tongue-sidewall virtual plane 98 of the sidewall 94 that includes the tongue 97. The tongue 97 extends outward beyond the primary tongue-sidewall virtual plane 98 by a lesser distance than the distance each ridge 99 extends beyond the tongue-sidewall virtual plane 98. Preferably, the distance by which the tongue 97 extends in an outward direction beyond the tongue-sidewall virtual plane 98 is less than half the distance by which each ridge 99 extends outward beyond the ridge-sidewall virtual plane 98.

The tongue 97 also extends outward beyond the tongue-sidewall virtual plane 98 by a lesser distance than the distance by which each ridge 99 extends outward to the ridge-sidewall virtual plane 98. Preferably, the distance by which the tongue 97 extends in an outward direction beyond the tongue-sidewall virtual plane 98 is less than half the distance by which each ridge 99 extends outward to the ridge-sidewall virtual plane 98.

The tongue 97 also extends outward beyond the tongue-sidewall virtual plane 98 by a lesser distance than the distance by which each outer side of the tongue 97 extends outward to the tongue-sidewall virtual plane 98. When the tongue is split, as in this embodiment, the distance(s) by which the inner sides (inside the split) of the tongue extend is immaterial. Preferably, the distance by which the tongue 97 extends in an outward direction beyond the tongue-sidewall virtual plane 98 is less than half the distance by which each outer side of the tongue 97 extends outward to the tongue-sidewall virtual plane 98.

In other respects, the building element 92 described in relation to FIGS. 8 and 8A preferably is configured and dimensioned in the same manner as the building element 10 described above in relation to FIGS. 1, 2 and 2A.

In other embodiments in which the grooves and tongues are disposed and respectively extend in relation to the primary surface 95 and the respective virtual planes 98, as shown in and described with reference to FIGS. 8 and 8A, any particular sidewall may include none, one or more than one such groove 96 and/or tongue 97.

Although the primary surfaces of the sidewalls that include ridges and/or tongues are approximately planar in the embodiments of the present invention shown and described herein, in some embodiments not shown herein one or more of such primary surfaces are not planar.

Preferably, the toy building elements described herein are made by an injection molding process. The preferred material is polypropylene.

In at least some embodiments, the part of the distal portion of the at least one tongue having the predominant maximum width does not extend outward beyond the virtual plane of the sidewall that includes the at least one tongue.

In at least some embodiments, the part of the entry opening of the at least one groove having the predominant minimum width is situated outward beyond the virtual plane of the sidewall that includes the at least one pair of ridges.

Regarding the incorporation by reference of disclosures from U.S. Pat. Nos. 6,250,986, 6,447,360 and 6,616,499, the meaning of the terms that are used both herein and in such patents should be interpreted within the context of the present specification and drawing.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents. The claims require no implicit limitations. Each claim is to be construed explicitly as stated, or by its legal equivalent.

The invention claimed is:

1. A building element for a set of toy building elements that are capable of being interconnected in a releasable engagement, comprising:

a top, a bottom and sidewalls;

wherein at least one of the sidewalls includes at least one pair of outwardly extending ridges forming a groove therebetween in the sidewall with an entry opening of a predominant minimum width;

wherein at least one of the sidewalls includes at least one outwardly extending tongue having a distal portion of a predominant maximum width that is greater than the predominant minimum width of the groove entry opening for interconnecting in a releasable restraining engagement within but not extending through a said groove in another said building element;

wherein the at least one tongue extends outward beyond a virtual plane of the sidewall that includes the at least one tongue, with said tongue-sidewall virtual plane being defined as a plane that passes through a midpoint of a line that connects a central point on an outer surface of the sidewall that includes the at least one tongue to a central point on an outer surface of the sidewall of the other building element that includes the at least one pair of ridges and is perpendicular to a line that passes through the central points of said interconnected building elements when said building elements are interconnected in a centered configuration;

wherein at least one ridge of said at least one pair of ridges extends outward beyond a virtual plane of the sidewall that includes the at least one pair of ridges, with said ridge-sidewall virtual plane being defined as a plane that passes through a midpoint of a line that connects a central point on an outer surface of the sidewall that includes the at least one pair of ridges to a central point on an outer surface of the sidewall of the other building element that includes the at least one tongue and is perpendicular to a line that passes through the central points of said interconnected building elements when said building elements are interconnected in a centered configuration; and wherein the at least one tongue extends outward beyond the tongue-sidewall virtual plane by a lesser distance than the distance by which each ridge of said at least one pair of ridges extends beyond the ridge-sidewall virtual plane.

2. A building element according to claim 1, wherein the distance by which said at least one tongue extends in an outward direction beyond the tongue-sidewall virtual plane is less than half the distance by which each ridge of said at least one pair of ridges extends outward beyond the ridge-sidewall virtual plane.

3. A building element according to claim 1, wherein at least one of the sidewalls includes both said at least one pair of outwardly extending ridges and said at least one outwardly extending tongue.

4. A building element according to claim 3, wherein each of the sidewalls includes both said at least one pair of outwardly extending ridges and said at least one outwardly extending tongue.

* * * * *